US005873772A

United States Patent [19]

Hajime et al.

[11] Patent Number: 5,873,772

[45] Date of Patent: Feb. 23, 1999

[54] METHOD FOR POLISHING THE TOP AND BOTTOM OF A SEMICONDUCTOR WAFER SIMULTANEOUSLY

[75] Inventors: Hirofumi Hajime, Miyazaki; Toshiharu Yubitani, Miyazaki-gun, both of Japan

[73] Assignee: Komatsu Electronic Metals Co., Ltd., Hiratsuka, Japan

[21] Appl. No.: 831,599

[22] Filed: Apr. 10, 1997

[51] Int. Cl.[6] ..... B24B 1/00; B24B 7/22

[52] U.S. Cl. ..... 451/41; 451/63; 451/262; 451/267; 451/269

[58] Field of Search ..... 451/41, 59, 63, 451/262, 267, 268, 286

[56] References Cited

U.S. PATENT DOCUMENTS

| | | | |
|---|---|---|---|
| 2,089,040 | 7/1937 | Shue | 451/262 |
| 2,291,123 | 7/1942 | Wallace | 451/268 |
| 3,691,694 | 9/1972 | Goetz et al. | 451/269 |
| 4,272,924 | 6/1981 | Masuko et al. | 451/41 X |
| 4,773,185 | 9/1988 | Taira | 451/269 |
| 5,099,614 | 3/1992 | Arai et al. | 451/262 X |
| 5,333,413 | 8/1994 | Hashimoto | 451/269 X |
| 5,394,655 | 3/1995 | Allen et al. | 451/41 X |
| 5,489,233 | 2/1996 | Cook et al. | 451/41 |
| 5,725,420 | 3/1998 | Torii | 451/41 X |

FOREIGN PATENT DOCUMENTS

| | | |
|---|---|---|
| 2-036066 | 2/1990 | Japan . |
| 2-294032 | 12/1990 | Japan . |
| 7-256560 | 10/1995 | Japan . |

*Primary Examiner*—Timothy V. Eley
*Attorney, Agent, or Firm*—Varndell Legal Group

[57] ABSTRACT

A method for polishing a semiconductor wafer is provided. A semiconductor wafer is detached from a polishing pad on a side of an upper polishing plate and is kept to be supported by a lower polishing plate. A contact area between the a wafer and the upper polishing plate is set to be less than a contact area between the wafer and the lower polishing plate. As a result, the wafer is definitely detached from the polishing pad on the side of the upper polishing plate and is to be kept supported by the lower polishing plate when the upper polishing plate is lifted.

4 Claims, 1 Drawing Sheet

METHOD FOR POLISHING THE TOP AND BOTTOM OF A SEMICONDUCTOR WAFER SIMULTANEOUSLY

BACKGROUND OF THE INVENTION

1. Field of the Invention

The present invention relates to a method for polishing a semiconductor wafer, especially to a method for polishing the semiconductor wafer by using a both-sides polishing apparatus to polish both side surfaces of the semiconductor wafer simultaneously.

2. Description of Prior Art

The flatness requirements for a semiconductor wafer are stricter than ever before. One of methods for the flatness of the semiconductor wafer is using a both-sides wafer polishing apparatus to polish both side surfaces of the semiconductor wafer simultaneously.

While polishing on the method, water layers containing grinding grains are sometimes formed between the wafer carrier and the polishing pads of the wafer polishing apparatus. This causes the semiconductor wafer to move freely between the water layers or even fall between the wafer carrier and the polishing pads. Furthermore, the friction between the wafer and the wafer carrier may damage the surfaces of the wafer.

The semiconductor wafer is not easily detached from the polishing pad under the water tension on the surfaces of the polishing pad. This may result in that the semiconductor wafer can not be retrieved.

Japanese Patent Laid Open 2-294032 and 2-36066 disclose methods to overcome the above problems, in which grid grooves are provided on the polishing pads to discharge the water on the polishing pads into the periphery of the polishing pads.

Accordingly, water layers are not formed on the surfaces of the polishing pads, and the water tension between the pad and the wafer can be reduced.

By using the polishing pads provided with grid grooves on the surfaces thereof, the semiconductor wafer can be easily detached from the polishing pad on the side of a lower polishing plate. However, the wafer adheres to the polishing pad on the side of an upper polishing plate when the upper polishing plate is lifted. As a result, the wafer can not be retrieved by the retrieving apparatus. Consequently, the wafer may fall and break.

SUMMARY OF THE INVENTION

In view of the above-mentioned problems, an object of the present invention is to provide a method for polishing a semiconductor wafer. According to this method, after both side surfaces of the wafer are polished, an upper polishing plate is lifted and the wafer can be detached from a polishing pad on a side of the upper polishing plate while it is kept to be supported by a lower polishing plate.

In this invention, polishing pads on sides of the upper and the lower polishing plates, wherein grid grooves are provided on polishing pads, are used to polish both side surfaces of the semiconductor wafer. The characteristic of this invention is that a contact area between the semiconductor wafer and the polishing pad on the side of the upper polishing plate is less than a contact area between the semiconductor wafer and a polishing pad on a side of the lower polishing plate.

Preferably, the contact area between the semiconductor wafer and the polishing pad on the side of the upper polishing plate may be more than 60% of an upper surface of the semiconductor wafer.

Preferably, the contact area between the semiconductor wafer and a polishing pad on the side of the lower polishing plate may be less than 90% of a lower surface of the semiconductor wafer.

As a result, the wafer can be certainly detached from the polishing pad on the side of the upper polishing plate and supported by the lower polishing plate when the upper polishing plate is lifted. This prevents the wafer from falling and getting damaged. Also, it becomes easier to retrieve the semiconductor wafer by using a retrieving apparatus.

BRIEF DESCRIPTION OF THE DRAWINGS

The present invention can be more fully understood by reading the subsequent detailed description and embodiments with references made to the accompanying drawings, wherein.

DETAILED DESCRIPTION OF THE PREFERRED EMBODIMENT

Figure 1:
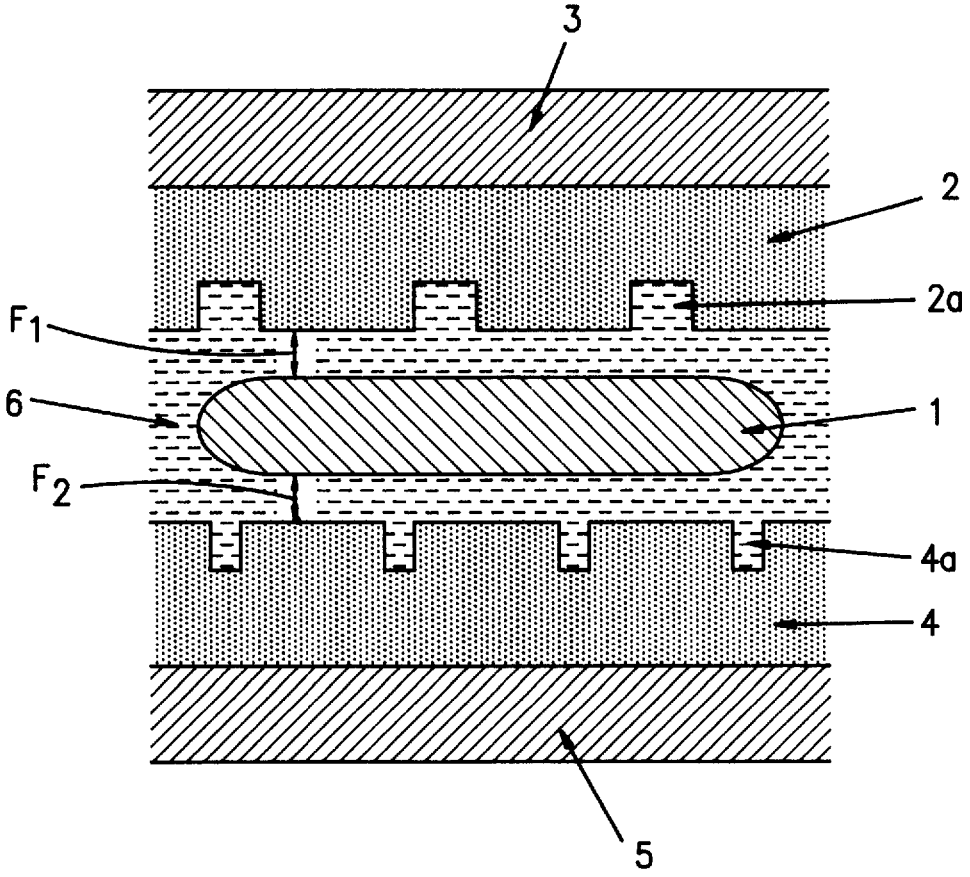
FIG. 1 shows the main portion of the wafer polishing apparatus according to the present invention in which a wafer having been polished is present.

As shown in FIG. 1, water 6 containing slurry is filled between a semiconductor wafer 1 to which the polishing process is finished and a polishing pad 2 on the side of the upper polishing plate 3, and between the semiconductor wafer 1 and a polishing pad 4 on the side of the lower polishing plate 5. This generates two tensions F1, F2; the tension F1 attracting the semiconductor wafer 1 and the polishing pad 2 each-other, and the tension F2 attracting the semiconductor wafer 1 and the polishing pad 4 each other. The conditions of the surfaces of the polishing pads 2, 4 and the surfaces of the wafer 1 have great influence on the tensions F1, F2.

Suppose that there is no tension F2, the wafer 1 cannot be lifted by the polishing pad 2 on the side of the upper polishing plate 3 if the tension F1 is smaller than the weight of the wafer 1.

The inventors learned through experiments that if less than 12% of the upper surface of the wafer 1 is in contact with the polishing pad 2, the wafer 1 can be detached from the polishing pad 2. In other words, the wafer 1 cannot be lifted by the polishing pad 2 if more than 88% of the upper surface of the wafer 1 is not in contact with the polishing pad 2. The areas of the upper and lower surfaces of the wafer 1 which are not in contact with the polishing pad 2 and 4 are equal to the areas occupied by the grooves 2*a* and 4*a* in the polishing pads 2 and 4, respectively. Therefore, the ratios of the areas of the upper and lower surfaces of the wafer 1 which are in contact with the polishing pad 2 and 4 with respect to the whole upper and lower surfaces of the wafer 1 are approximately equal to the ratios of the areas of non-grooved surfaces of the polishing pads 2 and 4 with respect to the whole surface areas of the polishing pads 2 and 4, respectively.

Accordingly, the wafer 1 can be kept to be supported by the lower polishing plate 5 and detached from the polishing pad 2 if the groove width and the size of a non-grooved surface defined by the grooves are set according to the conditions described below.

The method for determining the grooves on the polishing pad is described as follows:

To uniformly polish the wafer, the surface of the polishing pad needs to be arranged in a regular configuration.

From the viewpoints of pad-processing and water-discharging performances, it is best to arrange the grid grooves in the form of a square grid pattern, namely, where the grooves form a plurality of ungrooves surface portions in the shape of squares.

Concerning the relationship between the size of the ungrooved surface portions which are to be in contact with the wafer 1 and the width of the grooves, the configuration of large ungrooved portions and narrow grooves produce a uniform polishing result. While, a wide groove gives the polishing pad a better water-discharging performance.

How the contact area between the polishing pad and the wafer influences the polishing results is described hereinafter.

It is important to maintain a proper amount of contact area between the polishing pad and the semiconductor wafer. An overly small contact area increases the unacceptable roughness and diminishes the flatness of the wafer surface, while increasing the processing time. On the other hand, when the contact area is too large, water layers are easily generated. A preferred ratio of the contact area to the wafer surface is between 60% and 90%.

Accordingly, the preferred contact area between the wafer and the polishing pad on the side of the upper polishing plate is more than 60% of an upper surface of the wafer. The corresponding contact area between the wafer and the polishing pad on the side of the lower polishing plate needs to be greater than that between the wafer and the polishing pad on the side of the upper polishing plate.

Accordingly, the preferred contact area between the wafer and the polishing pad on the side of the lower polishing plate is less than 90% of a lower surface of the wafer. The corresponding contact area between the wafer and the polishing pad on the side of the upper polishing plate needs to be less than that between the wafer and the polishing pad on the side of the lower polishing plate.

The grooves on the polishing pad can be thus designed according to the above descriptions.

EMBODIMENT 1

(1) The Lower Polishing Plate:

The polishing pad 4 is provided with a plurality of grooves formed so as to define a plurality of squares having a side length of 40 mm. The groove width is set to be 5 mm. The summation of the squares or areas of the squares constitutes a contact portion of the polishing pad 4 with a wafer.

The preferred groove depth is about 1 mm under the considerations of the groove width, the pad thickness and its water-discharging performance.

(2) The Upper Polishing Plate:

The non-grooved surface defined by the grooves is set to be a square with a side of 20 mm. The groove width is set to be 6 mm. The contact portion per unit area is about 60% of the whole area, which is 76% of the contact area of the lower polishing plate.

EMBODIMENT 2

(1) The Lower Polishing Plate:

The non-grooved surface defined by the grooves is set to be a square with a side of 100 mm. The groove width is set to be 5 mm. The contact portion per unit area is about 90% of the whole area.

The preferred groove depth is about 1 mm under the considerations of the groove width, the pad thickness and its water-discharging performance.

(2) The Upper Polishing Plate:

The non-grooved surface defined by the grooves is set to be a square with a side of 45 mm. The groove width is set to be 5.6 mm. The contact portion per unit area is about 79% of the whole area, which is 88% of the contact area of the lower polishing plate.

According to the arrangement of this invention, the semiconductor wafer can be detached from the polishing pad on the side of the upper polishing plate when the upper polishing plate is lifted. Therefore, the wafer does not fall and get damaged. Moreover, when the wafer is to be polished and then washed automatically, the polished wafer can definitely be sent to the washing site after it is polished.

Although this invention has been described in its preferred forms and various embodiments with a certain degree of particularity, it is understood that the present disclosure of the preferred forms and the various embodiments can be changed in the details of construction. The scope of the invention should be determined by the appended claims and not by the specific embodiments given herein.

What is claimed is:

1. A method for simultaneously polishing a top and bottom of a semiconductor wafer using a wafer polishing apparatus having upper and lower polishing plates respectively having upper and lower polishing pads thereon, the upper and lower polishing pads having grooves arranged in a grid pattern and the grid patterns of the upper and lower polishing pads are different.

2. The method for polishing a semiconductor wafer as claimed in claim 1, wherein a contact area between the semiconductor wafer and the upper polishing pad is more that 60% of an upper surface area of the semiconductor wafer.

3. The method for polishing a semiconductor wafer as claimed in claim 1, wherein a contact area between the semiconductor wafer and the lower polishing pad is less than 90% of a lower surface area of the semiconductor wafer.

4. The method for polishing a semiconductor wafer as claimed in claim 1, wherein said grooves are arranged so that the wafer is supported by the lower polishing plate and is detachable from the lower polishing pad.

* * * * *